US006988615B2

(12) United States Patent
Merkel et al.

(10) Patent No.: US 6,988,615 B2
(45) Date of Patent: Jan. 24, 2006

(54) APPLIANCE SHIPPING PACKAGE

(75) Inventors: Roger L. Merkel, Evansville, IN (US); James A. Weinzapfel Jr., Evansville, IN (US); David L. Benefiel, Oakland City, IN (US); Gene A. Sparks, Evansville, IN (US); Lisa J. Culter, Princeton, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 237 days.

(21) Appl. No.: 10/439,639

(22) Filed: May 16, 2003

(65) Prior Publication Data

US 2004/0226840 A1 Nov. 18, 2004

(51) Int. Cl.
*B65D 81/02* (2006.01)

(52) U.S. Cl. ..... 206/320; 206/586; 206/597; 206/497

(58) Field of Classification Search ..... 206/320, 206/386, 453, 586, 597, 497
See application file for complete search history.

(56) References Cited

U.S. PATENT DOCUMENTS

| | | | | | |
|---|---|---|---|---|---|
| 2,340,387 | A | * | 2/1944 | Hummel | 206/586 |
| 2,575,784 | A | * | 11/1951 | Baumann | 206/320 |
| 3,675,765 | A | | 7/1972 | Melsek | 206/46 |
| 3,891,086 | A | * | 6/1975 | Isaacs | 206/320 |
| 3,907,241 | A | * | 9/1975 | Oglesby et al. | 248/346.4 |
| 4,226,327 | A | | 10/1980 | Ballard | 206/320 |
| 4,610,355 | A | * | 9/1986 | Maurer | 206/386 |
| 4,811,840 | A | | 3/1989 | Muyskens | 206/320 |
| 5,069,338 | A | | 12/1991 | Grigsby | 206/319 |
| 5,131,541 | A | | 7/1992 | Liebel | 206/453 |
| 5,161,692 | A | * | 11/1992 | Knierim | 206/586 |
| 5,175,041 | A | * | 12/1992 | Webb et al. | 428/116 |
| 5,277,310 | A | * | 1/1994 | Mertz | 206/320 |
| 5,289,969 | A | | 3/1994 | Schwaner | 229/23 |
| 5,307,928 | A | * | 5/1994 | Bishop | 206/320 |
| 6,357,587 | B1 | * | 3/2002 | Melms, Jr. | 206/326 |

* cited by examiner

*Primary Examiner*—David T. Fidei
(74) *Attorney, Agent, or Firm*—Stephen Krefman; John F. Colligan; Robert O. Rice

(57) ABSTRACT

A shipping package for household appliances such as refrigerators, freezers, compact ice makers and air conditioners for movement by clamp lift trucks. The appliance can be mounted on recycled high density polyethylene skids attached to the bottom of the appliance. The shipping package can include four elongated expanded polystyrene blocks positioned at the corners of the appliance extending vertically from the skids to the top of the appliance. The shipping package can include expanded polystyrene top pads on the top of the appliance and can include a fiberboard top cap covering the top pads and the top the appliance. Shrink wrap film can enclose the top cap, elongated blocks and engage the skids for holding the elongated blocks and top cap securely in position on the appliance.

20 Claims, 8 Drawing Sheets

APPLIANCE SHIPPING PACKAGE

BACKGROUND OF THE INVENTION

This invention relates to shipping packages for household appliances capable of being stacked several units high in a warehouse and accepting side loads from clamp lift truck material handling equipment. In packaging for some household appliances such as refrigerators and freezers, it is desirable to have packaging that protects the product yet allows the product to be viewed through the package for inspection in transit from the factory to the consumer's home. Further, it is desirable to have packaging that is adapted for easy installation, removal and disposal and efficient movement by lift trucks. Further, it is desirable to have packages that are capable of being stacked multiple units high in warehouses without tipping or leaning.

DESCRIPTION OF THE DRAWINGS

In the drawings illustrating the present invention.

DESCRIPTION OF THE INVENTION

Figure 4:
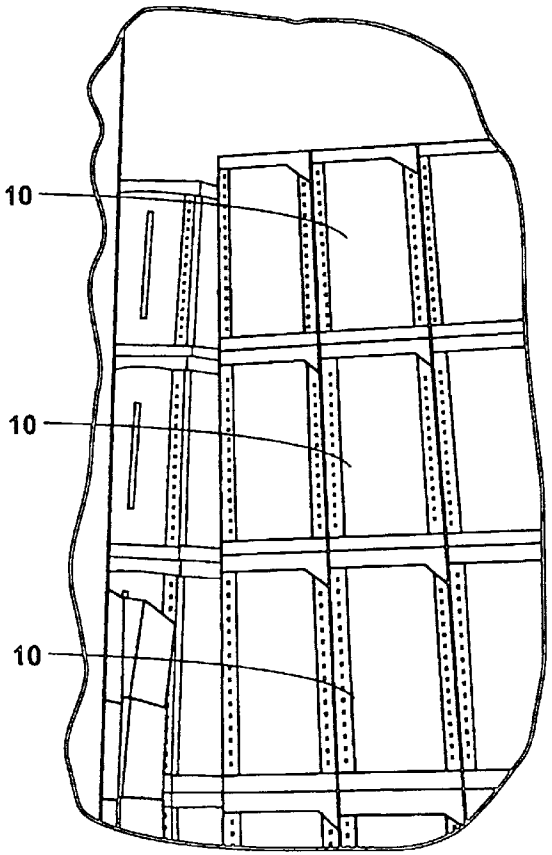
Fig. 4 (PRIOR ART)
FIG. 4 (prior art) is a front view of refrigerators in prior art shipping packages stacked in a warehouse showing stack lean due to shipping packages that have top or bottom surfaces that are not flat.
Figure 5:
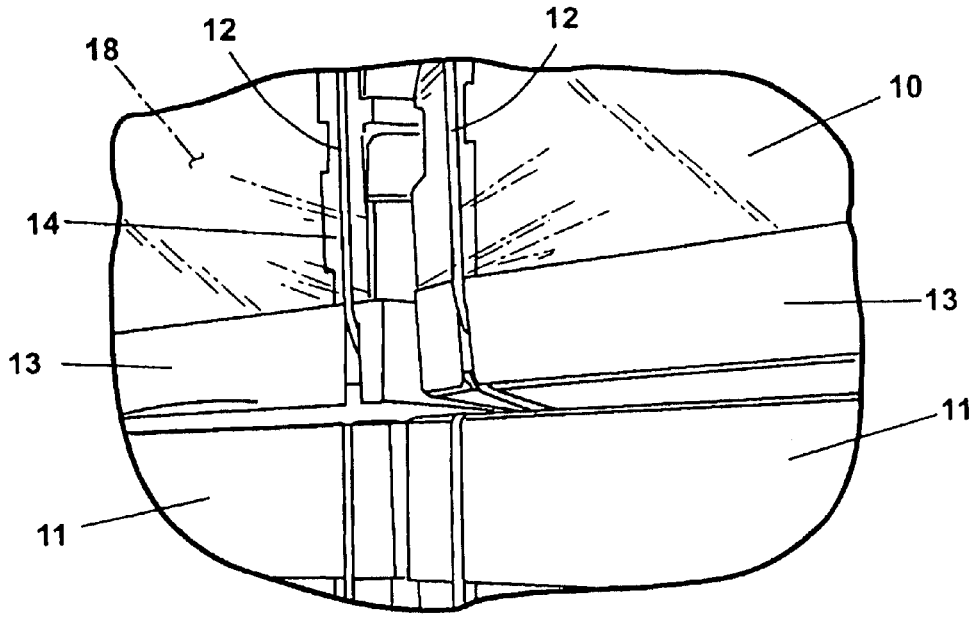
Fig. 5 (PRIOR ART)
FIG. 5 (prior art) is a partial perspective view of refrigerators in prior art shipping packages stacked in a warehouse showing rounded bottom caps due to strapping band tension.
Figure 6:
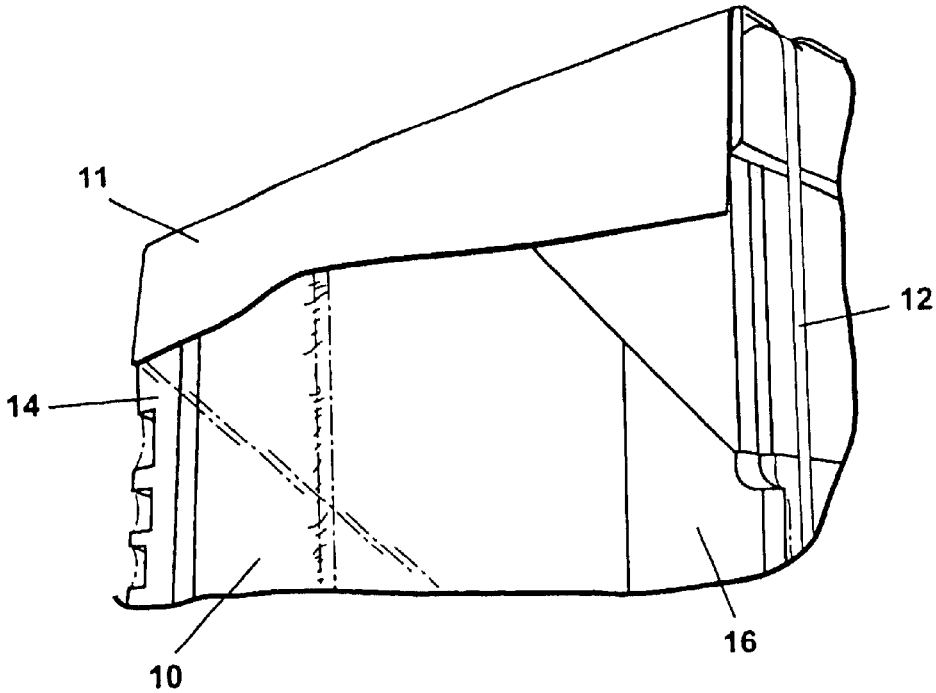
Fig. 6 (PRIOR ART)
FIG. 6 (prior art) is a partial perspective view of a refrigerator in a prior art shipping package showing one side of a top cap buckled due to strapping band tension.

Referring to FIG. 5 and FIG. 6 prior art shipping packages 10 for refrigerators and freezers are shown. Typical prior art shipping packages 10 include a top folded cap 11, a bottom cap 13, a plurality of strapping bands 12, elongated blocks or corner posts 14 and 16 located at the front and rear corners of the refrigerator cabinet and shrink film material 18. In the prior art shipping package shown in FIG. 4 to FIG, 6, the shrink wrap film 18 envelops and encloses corner posts 14 and 16 and bottom cap 13. Strapping bands 12 are fastened over a top cap 11 and the shrink film enclosed refrigerator, bottom cap and corner posts. Shipping packages utilizing strapping bands 12 are typically used when the shipping packages are intended to be lifted by the top cap with a lift truck having an upstanding lift member or fingers that hook under and engage a carton flap at the top of the package to lift and transport the package. Lift truck attachments to lift folded cap cartons by the top are commercially available and well known to those skilled in the art. When a relatively heavy product such as a refrigerator or freezer is packaged in a top lift carton strapping bands are commonly used to assure that the entire shipping package bottom is securely connected to the top cap.

Deficiencies with the prior art top lift shipping packages 10 can be seen by referring to FIG. 4 to FIG. 6 (prior art). Referring first to FIG. 6, in prior art top lift shipping packages the tension in strapping bands 12 can cause the sides of the top cap 11 to buckle and protrude out from the sides of the package. Such bulges can cause one shipping package to snag on another as products are moved, stacked, loaded or unloaded in the movement of the products from the factory to the consumer. Such snags can at best slow product handling and at worst cause product damage, dropped products and the like. Further, since cap 11 in this prior art embodiment is not enclosed by the shrink wrap film material 18, the fiberboard material typically used for carton material can become soaked or soggy should the product be exposed to the elements or high humidity conditions in transit from factory to consumer. When such fiberboard material becomes moisture laden, the material loses strength and can deform and sag leading to further instability when products having prior art shipping packages are stacked for storage or handling with a lift truck.

Referring now to FIG. 5 (prior art), the tension in strapping bands 12 can cause the bottom cap 13 to bow resulting in a package with a bottom wall or surface that is not flat. Such bowing can even occur when rigid skids attached to the bottom of the product are provided inside of, or instead of a bottom cap 13. The consequences of a shipping package having a bottom wall that is not flat can be seen by referring to FIG. 4 (prior art) in which it can be seen that stacks of refrigerators in prior art shipping packages lean. Leaning stacks of products can fall damaging both the falling products and products struck by falling products. In addition, undue care must be taken when handling and storing products having uneven shipping packages to avoid stacks of products falling in the warehouse and during handling with lift trucks and the like. Further, products with a bowed bottom cap as shown in FIG. 5 (prior art) are subject to rocking and vibrating when in transit subjecting the products to damage that would be avoided with a shipping package with a flat bottom wall. Still referring to FIG. 5 and FIG. 6 (prior art), as in the case of top cap 11, bottom cap 13 is subject absorbing moisture due to exposure to the elements or high humidity conditions in transit or in storage in route from the factory to the ultimate consumer's home. When bottom cap 13 becomes wet, stability of bottom cap 13 is adversely affected and can allow a stack of cartons to tip or fall.

Prior art top lift shipping packages as shown in FIG. 4 to FIG. 6 use strapping bands 12 to securely hold the shipping package about the product. However, such strapping bands 12 can hang up and catch on one another as products are being moved. Such hang ups at best slow down the efficient movement of products in the factory, warehouse and in loading/unloading of trailers and containers, and at worst can damage one or both products or cause products to be dropped damaging the product. In addition, strapping bands 12 can partially cover shipping labels or instructions that can include bar code information thus interfering with use of bar code reader equipment in a warehouse or in transit of the product.

Figure 1:
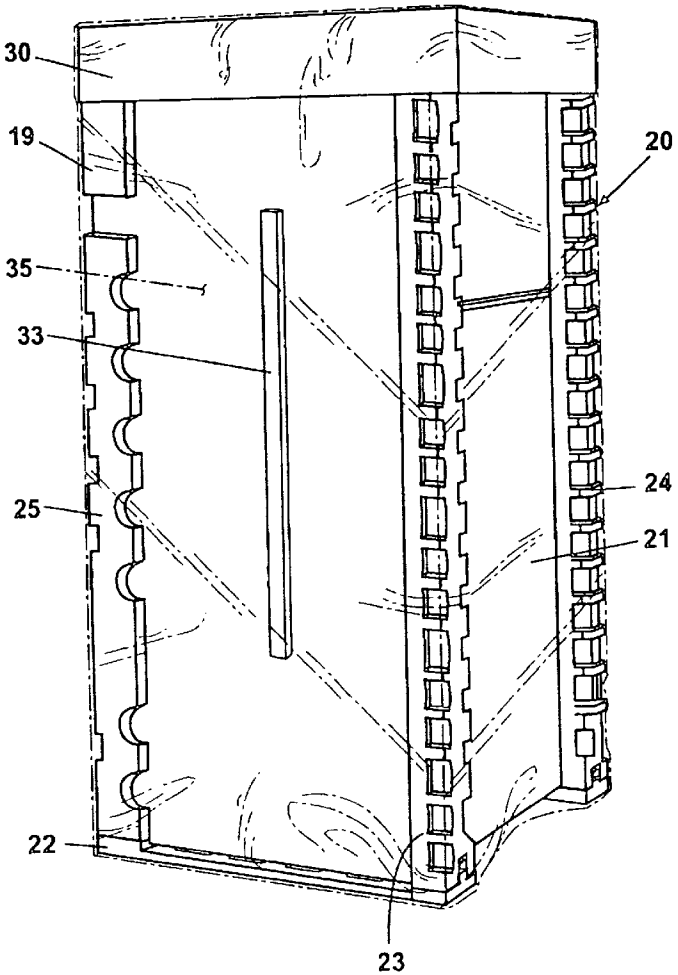
FIG. 1 is a perspective view of a refrigerator packaged in a shipping package according to the invention.
Figure 9:
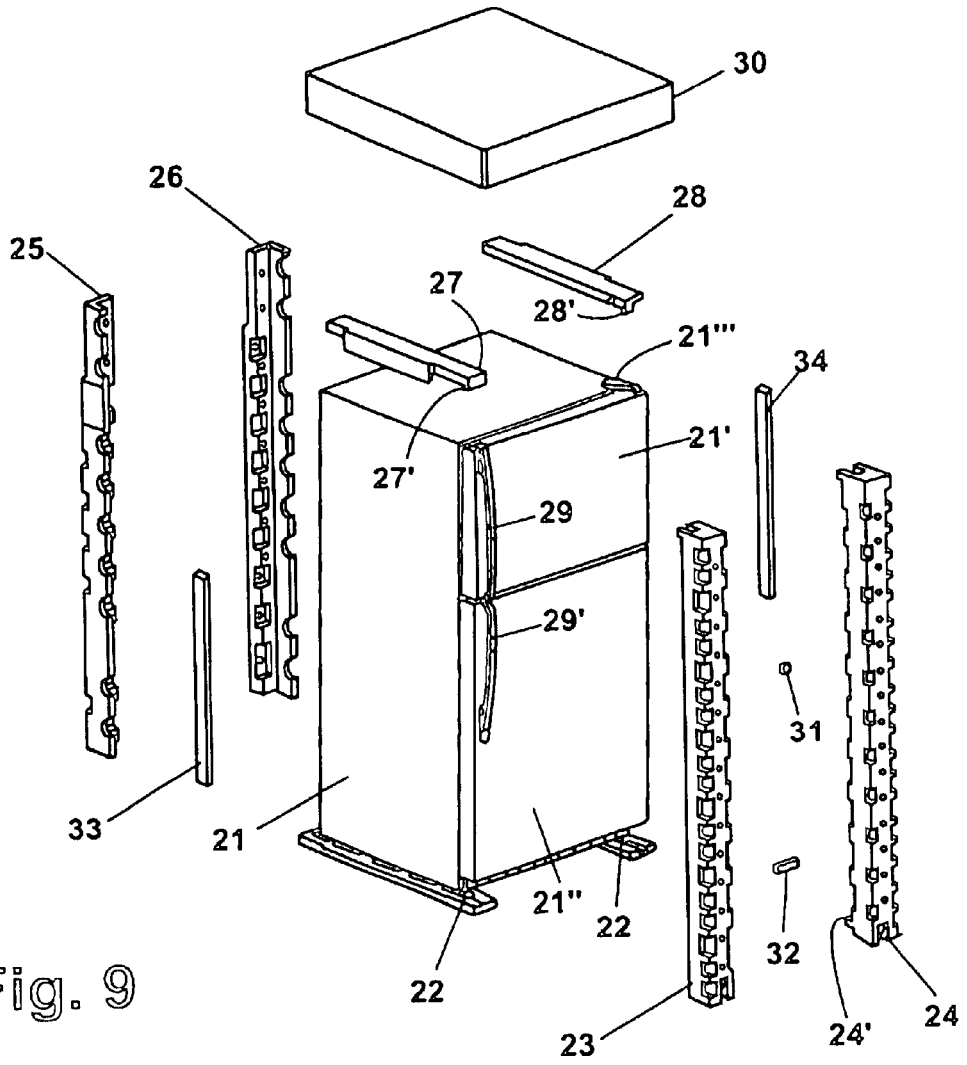
FIG. 9 is an exploded view of the shipping package elements according to the invention prior to application of shrink wrap film.
Figure 9A:
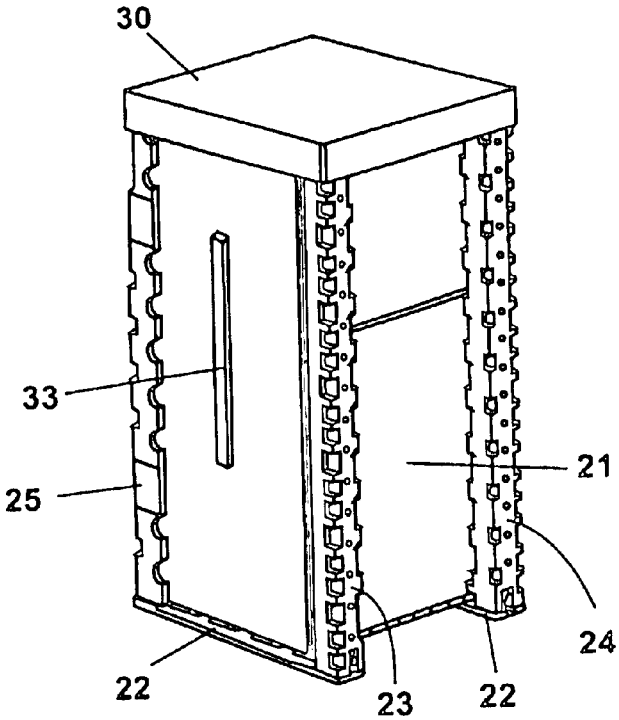
FIG. 9A is a front perspective view of the shipping package of FIG. 9 assembled on a refrigerator prior to application of shrink wrap film.
Figure 9B:
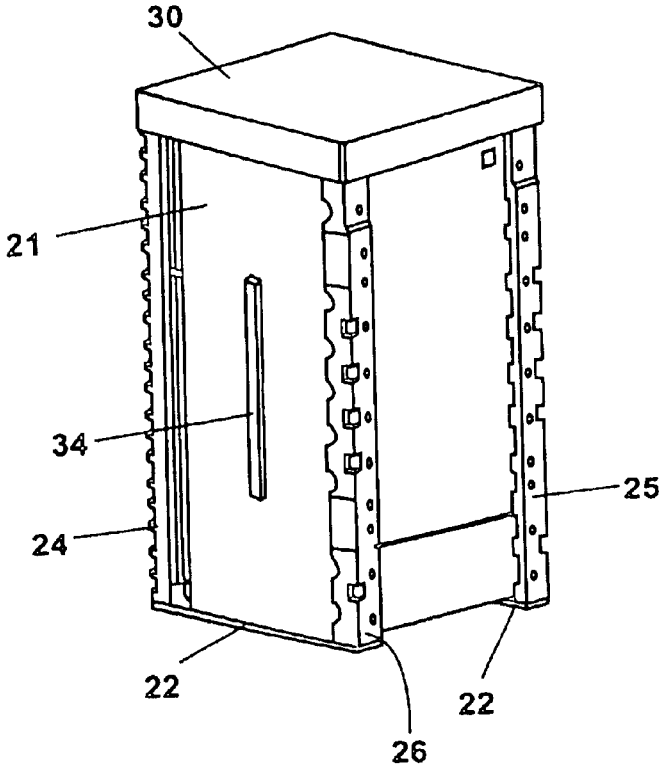
FIG. 9B is a rear perspective view of the shipping package of FIG. 9 assembled on a refrigerator prior to application of shrink wrap film.

Referring now to FIG. 1 and FIG. 9, a shipping package 20 according to the invention is shown. The shipping package 20 does not include a bottom cap and does not include or utilize strapping bands as provided in the prior art shipping packages described above. Shipping package 20 is intended for use with appliance clamp or carton clamp equipped material handling equipment or lift trucks that we will refer to generally as clamp lift trucks. In contrast to top handling lift trucks described above, clamp lift trucks have broad flat clamp members that engage opposite sides of an appliance shipping package. The clamp members are squeezed together with sufficient force to lift and transport multiple appliances in shipping packages. Clamp lift trucks are well known material handling equipment. Refrigerators, freezers, compact ice makers and air conditioners are examples of appliances that are well adapted to handling with clamp lift trucks since the cabinets of these appliances are relatively robust due to the nature and construction of the appliances. Such appliances require relatively little structural support from the shipping package to successfully withstand clamp lift truck handling.

Turning to FIG. 1 and FIG. 9, an embodiment of a shipping package 20 according to the invention is shown applied to a conventional refrigerator 21. While a conventional two-door top freezer refrigerator is shown in this embodiment, other refrigerator configurations such as side by side refrigerator-freezers, bottom freezer refrigerators, upright freezers or other household appliances such as mentioned above can be packaged with a shipping package according to the invention. A pair of skids 22 can be attached to the bottom of refrigerator 21 with suitable screws or bolts, not shown, with a portion of each skid extending along and beyond the sidewalls of the refrigerator 21. Skids 22 can also extend beyond the front and rear sides of the refrigerator 21. Skids 22 can be formed of rigid, moisture impervious material such as high density recycled polyethylene. Those skilled in the art will recognize that skids 22 can be formed of other sturdy, moisture resistant or moisture proof material such as wood or recycled polypropylene within the scope of this invention. While two separate skids 22 are shown in the embodiment of FIG. 1 and FIG. 9, a single skid extending the full width of the refrigerator could be used as will be readily understood by those skilled in the art.

Shipping package 20 can also include four elongated blocks or corner posts 23, 24, 25 and 26 (see FIG. 9). The bottom ends of elongated blocks 23–26 can rest on the top surface of skids 22 and can be held in place with tape, not shown, until the top cap and the shrink wrap material is applied. Elongated block 24 can have a bottom lip 24', to aid in supporting lower compartment door 21" during transit. A similar lip can be provided on elongated block 23, not shown. Elongated block 23 can engage and enclose the handle 29 on upper compartment door 21' and handle 29' on lower compartment door 21" to protect the handles during storage and transit. Those skilled in the art will recognize that handles 29 and 29' can packaged inside refrigerator 21 for installation at the time the refrigerator is installed in the consumer's home. Alternately, handles 29 and 29' can be supplied in a separate kit for installation on refrigerator 21 at the time the refrigerator is installed in the consumer's home. Elongated blocks 23–26 can be formed of 1.5 lb. density expanded polystyrene (EPS) material. EPS is rigid, with good compression resistance and is moisture proof and is not likely to abrade or scratch the refrigerator cabinet or door finish. Those skilled in the art will recognize that elongated blocks 23–26 can be formed of fiberboard material if desired. A suitable bar code shipping label 19 can be affixed to one of the elongated blocks, for example elongated block 25. Bar code shipping label 19 can be read by bar code reading equipment through shrink wrap film material 35.

In the embodiment shown in FIG. 1 and FIG. 9, top pads 27 and 28 can be positioned on the top wall of refrigerator 21. Top pads 27 and 28 can be held in position on refrigerator 21 with tape, not shown, until the top cap is installed and the shrink wrap film is applied. Top pads 27 and 28 provide a support base to protect the top of the refrigerator when refrigerators are stacked in a warehouse as is well known. Top pads 27 and 28 can easily support refrigerators stacked five units high in a warehouse without crushing. In addition, top pads 27 and 28 can have downwardly projecting edges 27' and 28' that fill the gap between the refrigerator cabinet, not shown, and the upper compartment door 21' to prevent the upper compartment door gasket, not shown, from collapsing during handling and transit. Top pads 27 and 28 can be formed of 2.0 lb. density EPS. While top pads 27 and 28 are shown as single blocks in the embodiment of FIG. 1 and FIG. 9, those skilled in the art will understand that top pads 27 and 28 can be formed in two or more pieces, if desired, to accommodate multiple appliance configurations.

Door support pads 31 and 32 can be provided for additional door support. Upper door support pad 31 can be wedged between upper compartment door 21' and lower compartment door 21" in the vicinity of handles 29 and 29' so as to provide support for the upper compartment door on the side of the refrigerator opposite the door hinges 21'". Lower door support pad 32 can be wedged between the face of the refrigerator cabinet, not shown, and the inner edge of lower compartment door 21", not shown, on the side of lower compartment door 21" opposite the door hinges, not shown, to keep the door gasket from collapsing during handling and transit. Door support pads 31 and 32 can be attached to refrigerator 21 by tape and can be formed of pressed fiberboard material that have good resistance to compression and do not mar the cabinet or door finish. Those skilled in the art will recognize that door support pads 31 and 32 can be formed of other materials such as 2.0 lb. density EPS if desired.

A top cap 30 can be positioned on top of refrigerator 21 overlying top pads 27 and 28 and enclosing the upper ends of elongated blocks 23–26. Top cap 30 can be formed of corrugated fiberboard with a continuous top surface to protect the top of the refrigerator during transit and storage to provide semi-water resistance and a dust cover for refrigerator 21. Top cap 30 can be a straight piece of fiberboard that is scored for folds and folded at the point of installation. The top cap 30 in the shipping package 20 according to the invention does not need to be folded and glued or stapled, as is the case with prior art top lift shipping packages. Top cap 30 can be formed of other material such as low density polyethylene or EPS.

Side protection pads 33 and 34 can be attached to the side walls of refrigerator 21 extending vertically between elongated blocks 23 and 25 and 24 and 26 respectively and held in place by tape, not shown, until the shrink wrap film 35 is applied. Side protection pads 33 and 34 can provide protection against incidental contact of the appliance clamp equipped lift truck with the sidewalls of refrigerator 21. Side support pads 33 and 34 can be formed of 1.5 lb. density EPS.

In the event shipping package 20 is utilized for a refrigerator 21 having horizontally extending door handles rather than the vertically extending door handles 29 and 29', those skilled in the art will recognize that a suitable handle support pad or pads, not shown, can be provided to protect such horizontally extending handles as elongated block 23 protects handles 29 and 29'.

The shipping package 20 according to the invention can be completed by application of shrink wrap material 35. Shrink wrap film 35 can be applied as a sheet of film wrapped around refrigerator 21, elongated blocks 23–26, top cap 30 and skids 22 and then sealed to form an envelop around the refrigerator using automatic equipment as is well known in the art. The shrink wrap film 35 can then be subjected to heat to shrink the film to securely engage the shipping package elements as is well known in the art. The shrink wrap film material can be 3.5 mil low density polyethylene material that on average shrinks approximately 40% when heated as is well known in the art. The shrink wrap film can be thinner or heavier than 3.5 mil material, for example, the film material can range from 2.0 mil to 4.0 mil material. The gage or thickness as well as the shrink factor and direction of primary shrinkage of the shrink wrap film material can be selected to meet the requirements of the specific shipping package as is well known to those skilled in the art. Alternately, shrink wrap film 35 can be applied in the form of a sleeve dropped down over top cap 30 to enclose elongated blocks 23–26 and skids 22 as above as is also well known in the art. The shrink wrap film 35 can be arranged to partially or fully cover top cap 30. When top cap 30 is formed of fiberboard and moisture and foreign matter damage is of concern, using shrink wrap film 35 that fully covers top cap 30 can provide additional protection for the refrigerator 21. Shrink wrap film 35 can engage skids 22, but typically does not enclose the entire bottom of refrigerator 21 since refrigerators typically have a recessed, closed bottom wall that does not require protection by the shrink wrap film. Further, leaving the bottom of the product open can keep moisture from staying in contact with the bottom of the product in the event the product is temporarily stored on a wet surface such as outdoors on a paved parking lot or storage area. The open portion of the shrink wrap film on the bottom of the product allows any moisture to evaporate rather than remain in contact with the underside of the product. Those skilled in the art will recognize that the shrink wrap film can be arranged to fully cover the bottom of the packaged product when the nature of the product requires full enclosure by the shrink wrap film to prevent moisture or foreign material from contacting the product.

While shrink wrap film 35 securely engages corner posts 23–26, top cap 30 and skids 22, the force exerted by the shrunk film is not sufficient to distort or bend top cap 30 to produce bulges as can be the case with prior art shipping package using strapping bands as shown in FIG. 4–FIG. 6. Similarly, the force exerted by the shrunk film is not sufficient to bend or warp skids 22 as can be the case with prior art shipping packages utilizing strapping bands.

The shipping package 20 according to the invention employs less packaging material than the prior art shipping packages described above. Given high production volume of refrigerators using shipping packages according to the invention, millions of board feet of wood can be saved through elimination of the bottom cap and other cardboard material required in the prior art shipping package. Elimination of the strapping bands, and bottom caps reduces the amount of material to be disposed in landfills and the like.

Figure 2:
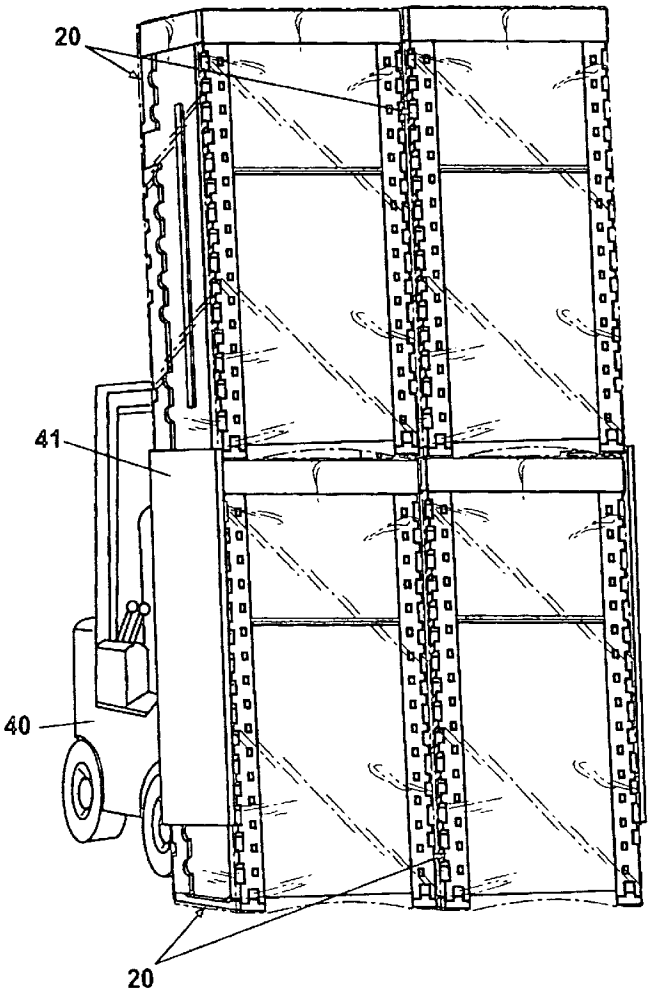
FIG. 2 is a front perspective view of four refrigerators stacked and engaged by a clamp lift truck.
Figure 3:
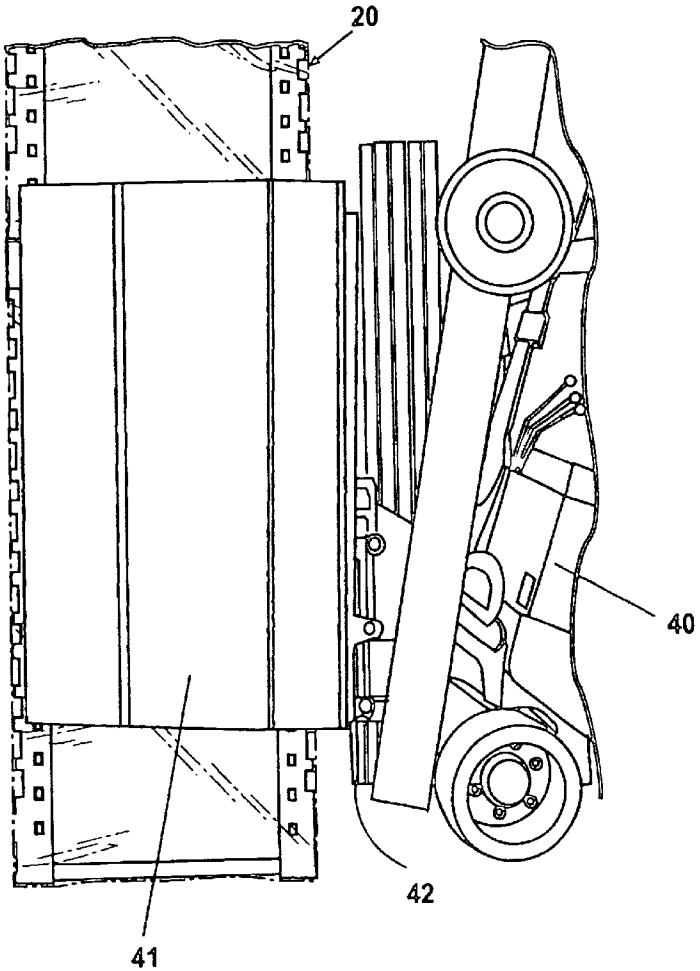
FIG. 3 is a side view of four refrigerators stacked and engaged by a clamp lift truck.

Thus, the shipping package 20 according to the invention, and as shown in FIG. 1 results in a shipping package with flat top and flat bottom surfaces that is readily handled by clamp lift trucks. Turning to FIG. 2 and FIG. 3 four shipping package units 20 are shown engaged by a clamp lift truck 40. Clamp lift truck 40 can include a pair of large clamp members 41 sized to securely engage either two shipping packages side by side or four shipping packages, two shipping packages stacked on top of two shipping packages. Clamp lift trucks 40 can include a lifting mechanism 42 as is well known to those skilled in the art.

Figure 8:
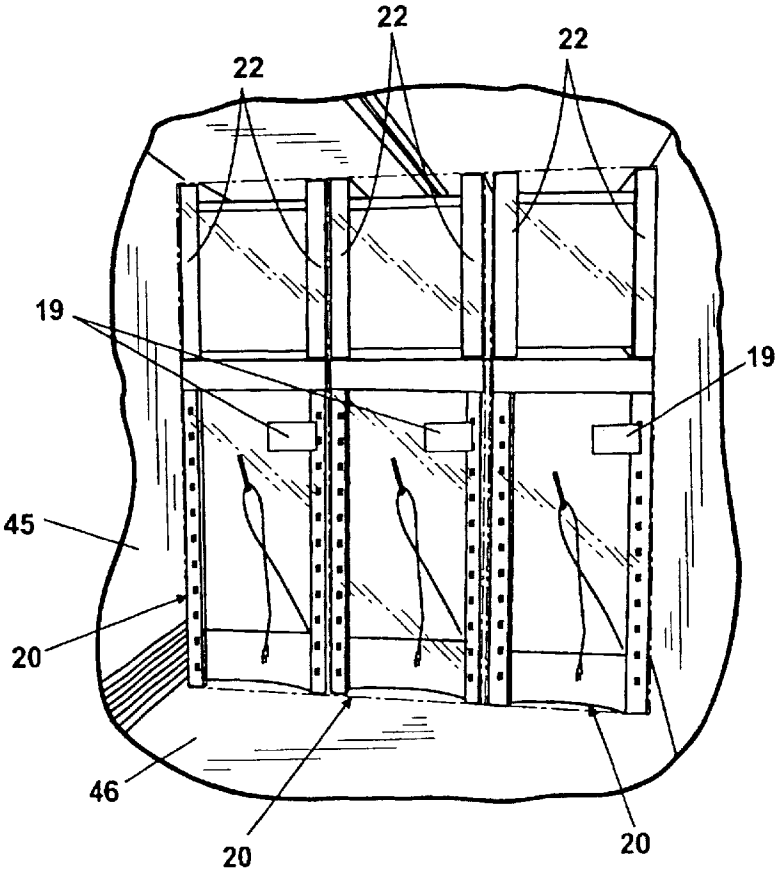
FIG. 8 is a perspective view of refrigerators in shipping packages according to the invention loaded in a trailer showing straight stacks and flat sides of the shipping package.
Figure 7:
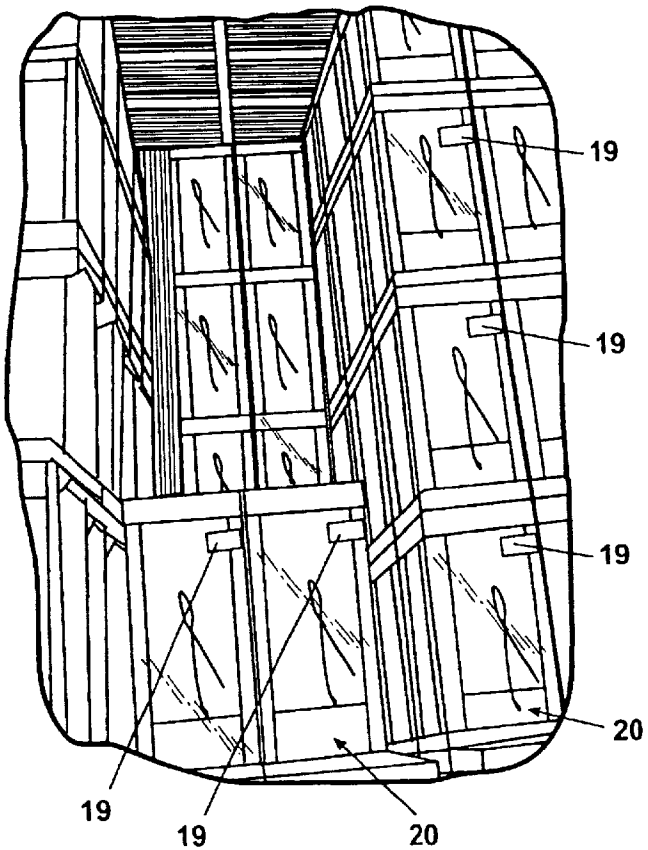
FIG. 7 is a perspective view of stacks of refrigerators in shipping packages according to the invention showing straight stacks resulting from use of shipping packages that have flat top and bottom surfaces.

Turning to FIG. 7 and FIG. 8 the advantage of the shipping package 20 according to the invention can readily be seen. In FIG. 7 stacks of shipping packages 20 are shown in a warehouse stacked 5 units high. It is significant to note that the stacks are straight and there are no bulges or protrusions from the shipping packages due to tension of strapping bands. The significance of straight stable stacks was demonstrated in one instance where several thousand units packaged in shipping packages and stacked according to the invention withstood a 5.0 magnitude level earthquake in a warehouse with no stacks falling. Turning to FIG. 8 shipping packages 20 are shown positioned in a trailer 45 for over the road transportation. It is significant to note that the shipping packages 20 fit together well since the sides of the packages are straight and the packages sit flat on the floor 46 of the trailer 45. As in the case of FIG. 7, there are no bulges or protrusions from the shipping packages to snag or hang up as shipping packages are loaded and unloaded from the trailer 45. The straight sides and flat top and bottom surfaces of the shipping packages 20 facilitates loading and unloading of a trailer 45 using a clamp truck since the clamp member can easily slide between shipping packages 20 and the trailer 45 without damaging the shipping packages or the enclosed refrigerators. Loading and unloading of trailer 45 with refrigerators having a shipping package according to the invention is also facilitated by the lack of bulges caused by strapping bands that can snag as refrigerators are moved in the tightly packed trailer 45.

Figure 10:
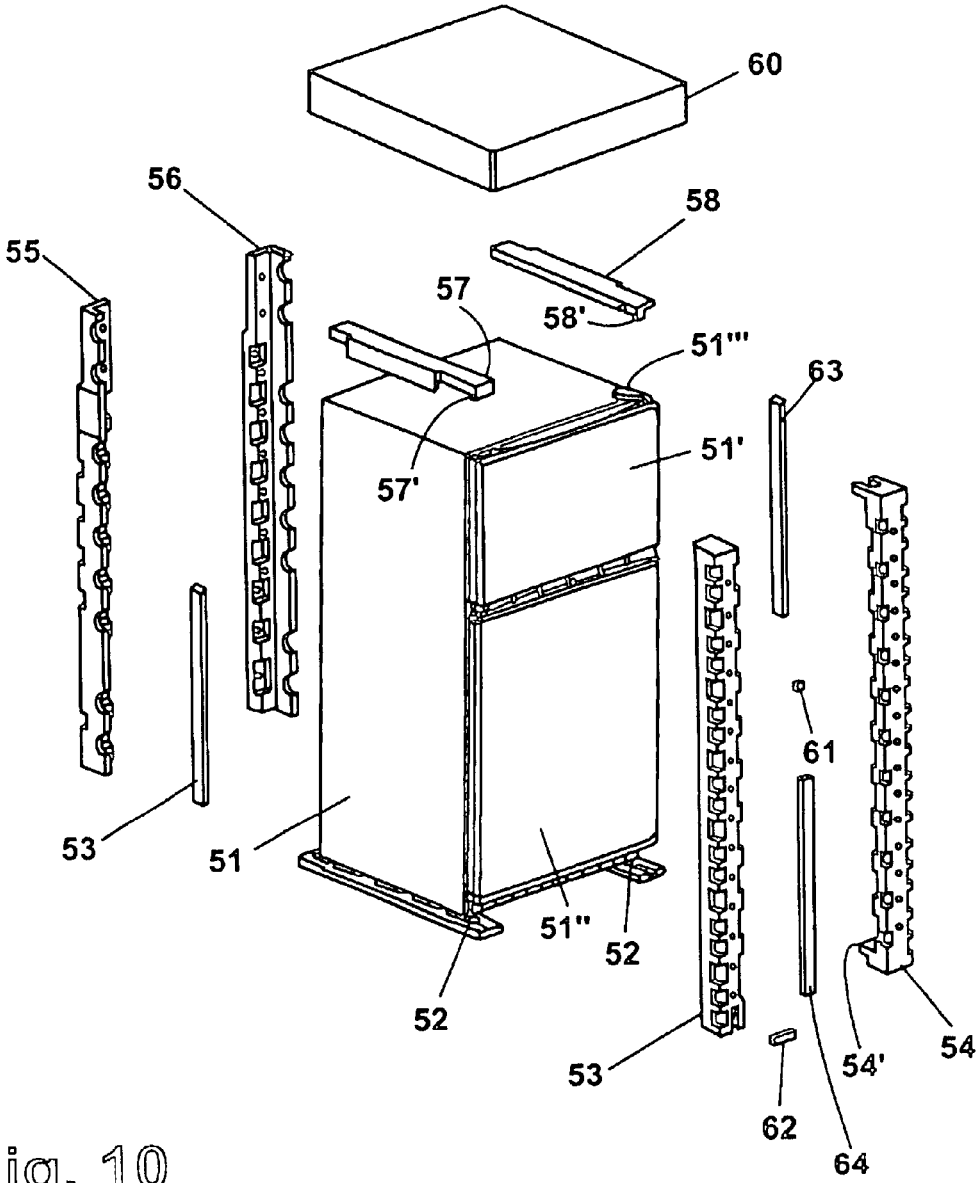
FIG. 10 is an exploded view of another embodiment of the shipping package elements according to the invention prior to application of shrink wrap film.
Figure 10A:
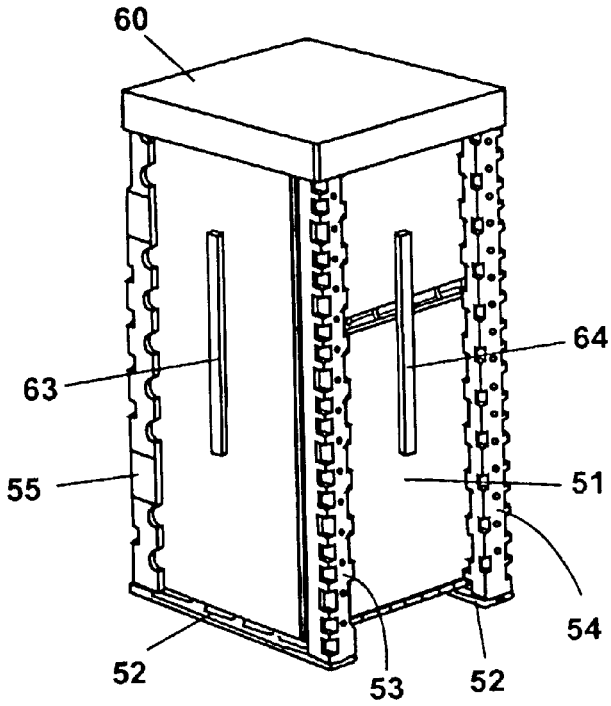
FIG. 10A is a front perspective view of the shipping package of FIG. 10 assembled on a refrigerator prior to application of shrink wrap film.
Figure 10B:
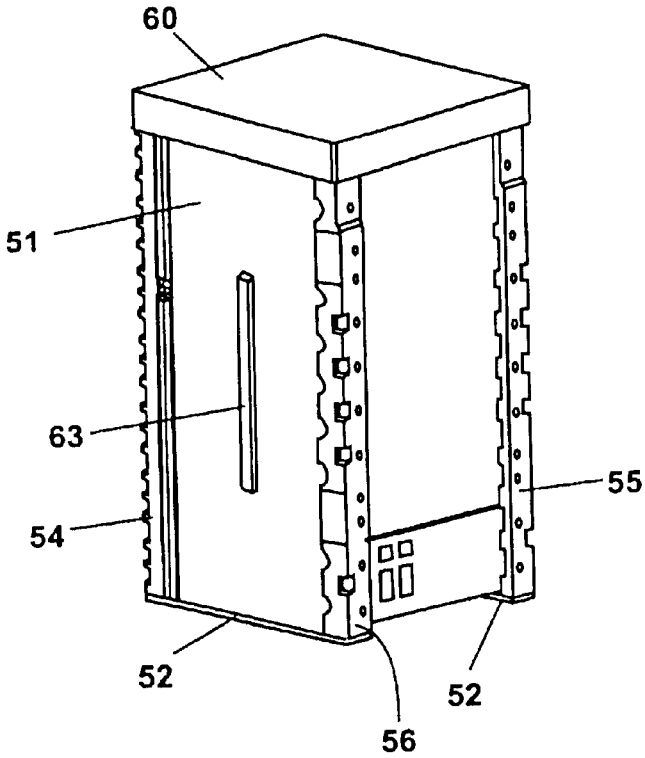
FIG. 10B is a rear perspective view of the shipping package of FIG. 10 assembled on a refrigerator prior to application of shrink wrap film.

Turning to FIG. 10 another embodiment of a shipping package according to the invention is shown for a refrigerator 51 having contoured or curved doors 51' and 51". In contrast, the refrigerator 21 shown in the embodiment of FIG. 1 and FIG. 9 has flat doors 21' and 21". Like the embodiment of FIG. 1 and FIG. 9, the shipping package shown in the embodiment of FIG. 10 does not include a bottom cap and does not include or utilize strapping bands as provided in prior art shipping packages. Refrigerator 51 can have a pair of skids 52 attached to the bottom wall of the refrigerator cabinet. While a conventional two-door top freezer refrigerator is shown in this embodiment, other refrigerator configurations such as a side by side refrigerator freezer, or a bottom freezer refrigerator can be packaged with a shipping package according to the invention. The pair of skids 52 can be attached to the bottom of refrigerator 51 with suitable screws or bolts, not shown, with a portion of each skid extending along and beyond the sidewalls of the refrigerator 51. Skids 52 can also extend beyond the front and rear sides of the refrigerator 51. Skids 52 can be formed of rigid, moisture impervious material such as high density recycled polyethylene. Those skilled in the art will recognize that skids 52 can be formed of other sturdy moisture resistant or moisture proof material such as recycled polypropylene or wood within the scope of this invention. While two separate skids 52 are shown in the embodiment of FIG. 10, a single skid extending the full width of the refrigerator could be used as will be readily understood by those skilled in the art.

The shipping package shown in FIG. 10 can also include four elongated blocks or corner posts 53, 54, 55 and 56. The bottom ends of elongated blocks 53–56 can rest on the top surface of skids 52 and can be held in place with tape, not shown, until the top cap and the shrink wrap material is applied. Elongated block 54 can have a bottom lip, shown at 54', to aid in supporting lower compartment door 51" during transit. A similar lip can be provided on elongated block 53, not shown. In the embodiment of FIG. 10, the refrigerator 51 does not have handles that extend outwardly from the compartment doors 51' and 51". Elongated blocks 53–56 can be formed of 1.5 lb. density expanded polystyrene (EPS) material. Those skilled in the art will recognize that elongated blocks 53–56 can be formed of other materials such as fiberboard if desired.

In the embodiment shown in FIG. 10, top pads 57 and 58 can be positioned on the top wall of refrigerator 51. Top pads 57 and 58 can be held in position on refrigerator 51 with tape, not shown. Top pads 57 and 58 provide a support base to protect the top of the refrigerator when refrigerators are stacked in a warehouse as is well known. Top pads 57 and 58 can easily support refrigerators stacked five units high in a warehouse without crushing. In addition, top pads 57 and 58 can have downwardly projecting edges 57' and 58' that fill the gap between the refrigerator 51 and the upper compartment door 51' to the prevent upper compartment door gasket, not shown, from collapsing during handling and transit. Top pads 57 and 58 can be formed of 2.0 lb. density EPS. Those skilled in the art will appreciate that top pads 57 and 58 can be assembled from two or more components rather than being formed in one piece as shown in FIG. 10.

Door support pads 61 and 62 can be provided for additional door support. Upper door support pad 61 can be wedged between upper compartment door 51' and lower compartment door 51" opposite the hinges 51'" to provide support for the upper compartment door on the side of the refrigerator opposite the door hinges 51'". Lower door support pad 62 can be wedged between the face of the refrigerator cabinet, not shown, and the inner edge of lower compartment door 51", not shown, opposite the door hinges, not shown, to keep the door gasket from collapsing during handling and transit. Door support pads 61 and 62 can be attached to refrigerator 51 by tape, not shown, and can be formed of pressed fiberboard material.

In the embodiment of FIG. 10 the shipping package can include additional support pads 63 and 64. Side support pads 63 can be placed on the sides of the refrigerator cabinet extending vertically between elongated blocks 53 and 55 and 54 and 56 respectively and held in place by tape, not shown, until the shrink wrap film 35 is applied. Front support pad 64 can be placed on the face of compartment doors 51' and 51" and held in place by tape, not shown, and can be centered between elongated blocks 53 and 54. Support pads 63 and 64 provide protection against incidental contact of the appliance clamp equipped lift truck with the sidewalls of the refrigerator and the compartment doors 51' and 51" during handling of the product. Support pads 63 and 64 can be formed of 1.5 lb. density EPS. It will be recognized by those skilled in the art that a front support pad like 64 can be provided in the shipping package shown in FIG. 1 and FIG. 9 to provide additional protection for doors 21' and 21". Likewise, those skilled in the art will recognize that support or protective pads can be provided as needed for portions of the surface of other products that are packaged with a shipping package according to the invention.

A top cap 60 can be positioned on top of refrigerator 51 overlying top pads 57 and 58 and enclosing the upper ends of elongated blocks 53–56. Top cap 60 can be formed of corrugated fiberboard with a continuous top surface to protect the top of the refrigerator during transit and storage. Top cap 60 can be formed of other material such as EPS, low density polyethylene or coated paper.

The shipping package shown in FIG. 10 can be completed by application of shrink wrap material 35. Shrink wrap film 35, not shown, can be applied as a sheet of film wrapped around refrigerator 51, elongated blocks 53–56, top cap 60 and skids 52 and then sealed to form an envelop around the refrigerator using automatic equipment as is well known in the art. The shrink wrap film 35, not shown, can then be subjected to heat to shrink the film to securely engage the shipping package elements as is well known in the art. The shrink wrap film material can be 3.5 mil low density polyethylene material that on average shrinks approximately 40% when heated as is well known in the art. The shrink wrap film can be thinner or heavier than 3.5 mil material, for example, the film material can range from 2.0 mil to 4.0 mil material. The gage or thickness as well as the shrink factor and direction of primary shrinkage of the shrink wrap film material can be selected to meet the requirements of the specific shipping package as is well known to those skilled in the art. Alternately, shrink wrap film 35, not shown, can be applied in the form of a sleeve dropped down over top cap 60 to enclose elongated blocks 53–56 and skids 52 as above as is also well known in the art. The shrink wrap film 35, not shown, can be arranged to partially or fully cover top cap 60. When top cap 60 is formed of fiberboard and moisture and foreign matter damage is of concern, using shrink wrap film 35, not shown, that fully covers top cap 60 can provide additional protection for the refrigerator 51. Shrink wrap film 35, not shown, can engage skids 52, but typically does not enclose the entire bottom of refrigerator 51 since refrigerators typically have a recessed, closed bottom wall that does not require protection by the shrink wrap film. Further, leaving the bottom of the product open can keep moisture from staying in contact with the bottom of the product in the event the product is temporarily stored on a wet surface such as outdoors on a paved parking lot or storage area. The open portion of the shrink wrap film on the bottom of the product allows any moisture to evaporate rather than remain in contact with the underside of the product. Those skilled in the art will understand that the shrink wrap film can be arranged to fully enclose the bottom of the product, if desired, when the product requires a shipping package that precludes moisture or foreign material from coming into contact with the bottom of the product during transit.

Thus, the shipping package embodiment shown in FIG. 10 results in a shipping package with flat top and flat bottom surfaces, that is readily handled by appliance clamp equipped lift trucks and provides all the benefits and advantages of the shipping package embodiment shown in FIG. 1 and FIG. 9.

While the shipping package according to the invention has been specifically described in connection with certain specific embodiments thereof and applied to refrigerators, it is to be understood that this is by way of illustration and not of limitation, and the scope of the appended claims should be construed as broadly as the prior art will permit.

We claim:

1. A shipping package for appliances for use with clamp material handling equipment comprising:

one or more skids attached to the bottom of said appliance extending along and beyond opposite sidewalls of said appliance and extending beyond the front and rear sides of said appliance;

four elongated blocks, each of said elongated blocks extending from one end of one of said one or more skids to the top of said appliance and engaging the adjacent vertical surfaces at one corner of said appliance;

one or more pads positioned on the top of said appliance along the same opposite sides of said appliance as said skids;

a fiberboard top cap overlying said pads and enclosing the upper ends of said elongated blocks; and shrink wrap film enveloping and shrunk to engage said top cap, said elongated blocks and said skids for holding said elongated blocks and fiberboard top cap securely in position on said appliance.

2. The shipping package of claim 1 wherein said shrink wrap film and said top cap enclose the top of said appliance to keep foreign material from contacting the top of said appliance.

3. The shipping package of claim 2 wherein said shrink wrap film completely envelops said top cap.

4. The shipping package of claim 1 wherein said one or more skids comprise two elongated skids formed of high density recycled polyethylene.

5. The shipping appliance of claim 1 wherein said elongated blocks are formed of expanded polystyrene.

6. The shipping package of claim 1 wherein said appliance is an upright freezer.

7. The shipping package of claim 1 wherein said appliance is a refrigerator-freezer.

8. The shipping package of claim 7 further including side support pads positioned between said elongated blocks positioned on at the corners of the sides of said appliance to provide additional protection for the sides of said appliance during transit.

9. The shipping package of claim 7 further including a front support pad positioned between said elongated blocks positioned at the front corners of said appliance to provide additional protection for the front of said appliance during transit.

10. The shipping package of claim 7 wherein said refrigerator-freezer has an upper compartment door and a lower compartment door, said shipping package further including a first fiberboard door support positioned between said doors opposite the hinges for said doors, and a second fiberboard door support positioned between said lower compartment door and said refrigerator-freezer cabinet opposite said hinges to provide additional support for said doors during transit.

11. A shipping package not having a bottom cap or strapping bands for an appliance for use with clamp lift trucks comprising:

two skids attached to the bottom of said appliance extending along and beyond opposite sidewalls of said appliance and extending beyond the front and rear sides of said appliance;

four elongated blocks, each of said blocks extending from one end of one of said skids to the top of said appliance and engaging adjacent vertical surfaces of said appliance at one corner of said appliance;

two top pads positioned on the top of said appliance and extending along the same sidewalls as said skids;

a top cap positioned on top of said appliance and said top pads and enclosing the top ends of said elongated blocks; and shrink wrap film enveloping and shrunk to engage said top cap, said elongated blocks and said skids for holding said elongated blocks and fiberboard cap securely in position on said cabinet.

12. The shipping package of claim 11 wherein said appliance has a cabinet and one or more compartment doors each having a gasket, and said top pads each comprise expanded polystyrene having a first elongated portion positioned along one of said sidewalls, and a second portion extending between said appliance cabinet and the upper one of said one or more compartment doors to prevent the gasket for said compartment door from collapsing during transit and handling.

13. The shipping package of claim 12 further including two expanded polystyrene side support pads positioned between said elongated blocks positioned on the sides of said appliance for protecting the sides of said appliance from incidental contact by said clamp lift truck during handling.

14. The shipping package of claim 12 further including an expanded front support pad positioned between said elongated blocks positioned at the front corners of said appliance for protecting said doors from incidental contact by said clamp lift truck during handling.

15. The shipping package of claim 11 wherein said appliance is a refrigerator-freezer having an upper compartment door and a lower compartment door, said shipping package further including fiberboard door supports positioned at the bottom of said doors opposite the hinges for said doors to provide additional support for said doors during transit.

16. The shipping package of claim 11 wherein said top cap is formed of corrugated fiberboard.

17. The shipping package of claim 16 wherein said shrink wrap film and said top cap enclose the top of said appliance to keep foreign material from contacting the top of said appliance.

18. The shipping package of claim 17 wherein said shrink wrap film completely envelops said top cap.

19. The shipping package of claim 11 wherein said skids are formed of high density recycled polyethylene.

20. The shipping package of claim 11 wherein said rigid elongated blocks are formed 1.5 lb. density expanded polystyrene.

* * * * *